US008408880B2

(12) United States Patent
Markefka

(10) Patent No.: US 8,408,880 B2
(45) **Date of Patent: *Apr. 2, 2013**

(54) JET SUCTION PUMP

(75) Inventor: Klaus Markefka, Florstadt (DE)

(73) Assignee: Continental Automotive GmbH, Hannover (DE)

( * ) Notice: Subject to any disclaimer, the term of this patent is extended or adjusted under 35 U.S.C. 154(b) by 477 days.

This patent is subject to a terminal disclaimer.

(21) Appl. No.: 11/908,745

(22) PCT Filed: Jan. 10, 2006

(86) PCT No.: PCT/EP2006/050111

§ 371 (c)(1),
(2), (4) Date: Sep. 14, 2007

(87) PCT Pub. No.: WO2006/100129

PCT Pub. Date: Sep. 28, 2006

(65) Prior Publication Data

US 2008/0193300 A1 Aug. 14, 2008

(30) Foreign Application Priority Data

Mar. 24, 2005 (DE) ..... 10 2005 014 431

(51) Int. Cl.
*F04B 23/08* (2006.01)

(52) U.S. Cl. ..... 417/87

(58) Field of Classification Search ..... 417/87, 417/89, 76, 84, 198; 137/571, 590, 565.01; 123/514

See application file for complete search history.

(56) References Cited

U.S. PATENT DOCUMENTS

| | | | | |
|---|---|---|---|---|
| 3,394,655 | A * | 7/1968 | Brown | 417/80 |
| 4,886,031 | A * | 12/1989 | Scheurenbrand et al. | 123/516 |
| 5,024,583 | A * | 6/1991 | Sasaki et al. | 417/198 |
| 6,123,511 | A * | 9/2000 | Sertier | 417/87 |
| 6,155,793 | A | 12/2000 | Tuckey et al. | 417/87 |
| 6,155,796 | A * | 12/2000 | Schmalz et al. | 417/187 |
| 6,296,454 | B1 * | 10/2001 | Schmid et al. | 417/151 |
| 6,457,945 | B2 * | 10/2002 | Kleppner et al. | 417/84 |
| 6,685,439 | B1 * | 2/2004 | Harrell et al. | 417/151 |
| 7,066,153 | B2 * | 6/2006 | Vitalis et al. | 123/514 |
| 2002/0031431 | A1 * | 3/2002 | Akiyama et al. | 417/198 |
| 2004/0177886 | A1 * | 9/2004 | Nagata et al. | 137/571 |
| 2005/0183781 | A1 | 8/2005 | Vitalis et al. | 137/565.22 |
| 2005/0241621 | A1 | 11/2005 | Kieninger et al. | 123/509 |
| 2007/0104589 | A1 | 5/2007 | Marx | 417/87 |

FOREIGN PATENT DOCUMENTS

| | | |
|---|---|---|
| DE | 1028283 B | 4/1958 |
| DE | 4336060 | 4/1995 |
| DE | 19805072 A1 | 8/1999 |
| DE | 19856298 C1 | 2/2000 |

(Continued)

OTHER PUBLICATIONS

Chinese Office Action, Application No. 20068000923.8, 5 pages, Mar. 27, 2009.

*Primary Examiner* — Devon Kramer
*Assistant Examiner* — Amene Bayou
(74) *Attorney, Agent, or Firm* — King & Spalding L.L.P.

(57) ABSTRACT

A jet suction pump (9) has a pump fluid nozzle (13) with a round nozzle opening, a mixing tube (14), a suction opening, a suction line (12) arranged thereon and a canister (8), in which at least a part of the mixing tube (14) is arranged. The base (16) of the canister (8) has a non-planar embodiment (17-19).

14 Claims, 4 Drawing Sheets

FOREIGN PATENT DOCUMENTS

| | | | |
|---|---|---|---|
| DE | 19855433 | | 6/2000 |
| DE | 10237050 | B3 | 4/2004 |
| DE | 102005002264 | A1 | 8/2005 |
| EP | 1378670 | | 1/2004 |
| GB | 221575 | A | 9/1924 |
| JP | 7304340 | | 11/1995 |
| WO | 2004018864 | | 3/2004 |
| WO | 2004018864 | A | 3/2004 |
| WO | 2004111427 | | 12/2004 |

* cited by examiner

JET SUCTION PUMP

CROSS-REFERENCE TO RELATED APPLICATIONS

This application is a U.S. national stage application of International Application No. PCT/EP2006/050111 filed Jan. 10, 2006, which designates the United States of America, and claims priority to German application number 10 2005 014 431.4 filed Mar. 24, 2005, the contents of which are hereby incorporated by reference in their entirety.

TECHNICAL FIELD

The subject of the invention concerns jet suction pumps.

BACKGROUND

Such jet suction pumps may have a propulsion jet nozzle, a mixing pipe, a suction opening, a suction line connected thereto and a pot, in which at least part of the mixing pipe is arranged. The jet suction pump is used to deliver fuel within a fuel container or from a fuel container into a baffle pot which is arranged within the fuel container.

It is known that fuel containers have many shapes. With the adaptation of the fuel container to the vehicle, using the available space, fuel containers which are subdivided into a plurality of chambers are produced.

These chambers are for the most part connected to a saddle. In such fuel containers, the problem arises that, when there is a low level, the fuel can no longer get from one chamber over the saddle into the other chamber. Since usually only one delivery unit is arranged in a fuel container, the fuel located in another chamber cannot reach the delivery unit. In these cases, jet suction pumps are used to feed the fuel present in other regions of the fuel container to the delivery unit or to deliver the fuel at least into the chamber or the region in which the delivery unit is located.

Conventional jet suction pumps are arranged at the bottom of the chambers or the regions of the fuel container from which the fuel is to be delivered to the delivery unit. With the arrangement of the suction opening of the jet suction pump at the bottom of the fuel container, the jet suction pump is always in the fuel and is thus always ready to operate. Jet suction pumps of this type are distinguished by good efficiency.

The delivery factor, that is the ratio of combined jet to propulsion jet, is at least 7. The disadvantage in this case is that, with the propulsion line to the jet suction pump and the combined line from the jet suction pump, two lines are required, which have to be laid and fixed in the fuel container.

Furthermore, it is known to use sucking jet suction pumps which are arranged in the region of the delivery unit. From the jet suction pump, a suction line leads in the region from which the fuel is to be delivered. In order to produce the necessary negative pressure in the suction line, the jet suction pump has a specific propulsion jet nozzle. The outlet opening of the propulsion jet nozzle is designed as a slot. As a result of the slot, the propulsion jet fans out after emerging from the propulsion jet nozzle. The fanned out propulsion jet closes the mixing tube, by which means the necessary negative pressure is produced in order to be able to suck in the fuel over the relatively long suction line. As a result, only one line instead of two lines as hitherto has to be laid in the fuel container and to be fixed. The disadvantage with this arrangement is the low delivery factor of the sucking jet suction pump, which is approximately 2. This low delivery factor is caused by the propulsion jet fanning out after leaving the propulsion jet nozzle.

Furthermore, a jet suction pump is known which, with the outlet end of the mixing pipe, is arranged in a pot, so that the delivery medium in the pot seals off the end of the mixing pipe with respect to the atmosphere. By means of this liquid closure, a negative pressure will be produced at the entry to the mixing pipe, which contributes to improving the suction performance. However, it has been shown that, under certain conditions, the suction performance is no longer achieved, which allows it to be concluded that the liquid closure of the outlet of the mixing pipe is not always ensured. This can be caused, for example, by there being too low a quantity of the delivered liquid in the pot.

SUMMARY

A suction jet suction pump having an improved delivery factor, the suction performance being ensured even under unfavorable conditions. Furthermore, the jet suction pump is to be constructed simply and compactly and to be easy to mount.

According to an embodiment, a jet suction pump may comprise a propulsion jet nozzle with a round nozzle opening, a mixing pipe, a suction opening, a suction line arranged thereon and a pot, in which at least part of the mixing pipe is arranged, wherein the bottom of the pot has a shape differing from a planar surface.

According to a further embodiment, the shape differing from a planar surface can be a depression or ribs or a funnel-like bottom surface. According to yet a further embodiment, the depression or the ribs of the bottom can be arranged in the region of the outlet opening of the mixing pipe. According to yet a further embodiment, the pot can be connected to the jet suction pump. According to yet a further embodiment, the pot can be connected to the jet suction pump by means of a latching or plug-in connection. According to yet a further embodiment, the pot can be integrally formed on the jet suction pump. According to yet a further embodiment, the pot can be welded or adhesively bonded to the jet suction pump. According to yet a further embodiment, the pot can be formed on a baffle pot or in a region of the baffle pot.

BRIEF DESCRIPTION OF THE DRAWINGS

The invention will be explained in more detail using a number of exemplary embodiments. Here.

DETAILED DESCRIPTION

Figure 1:
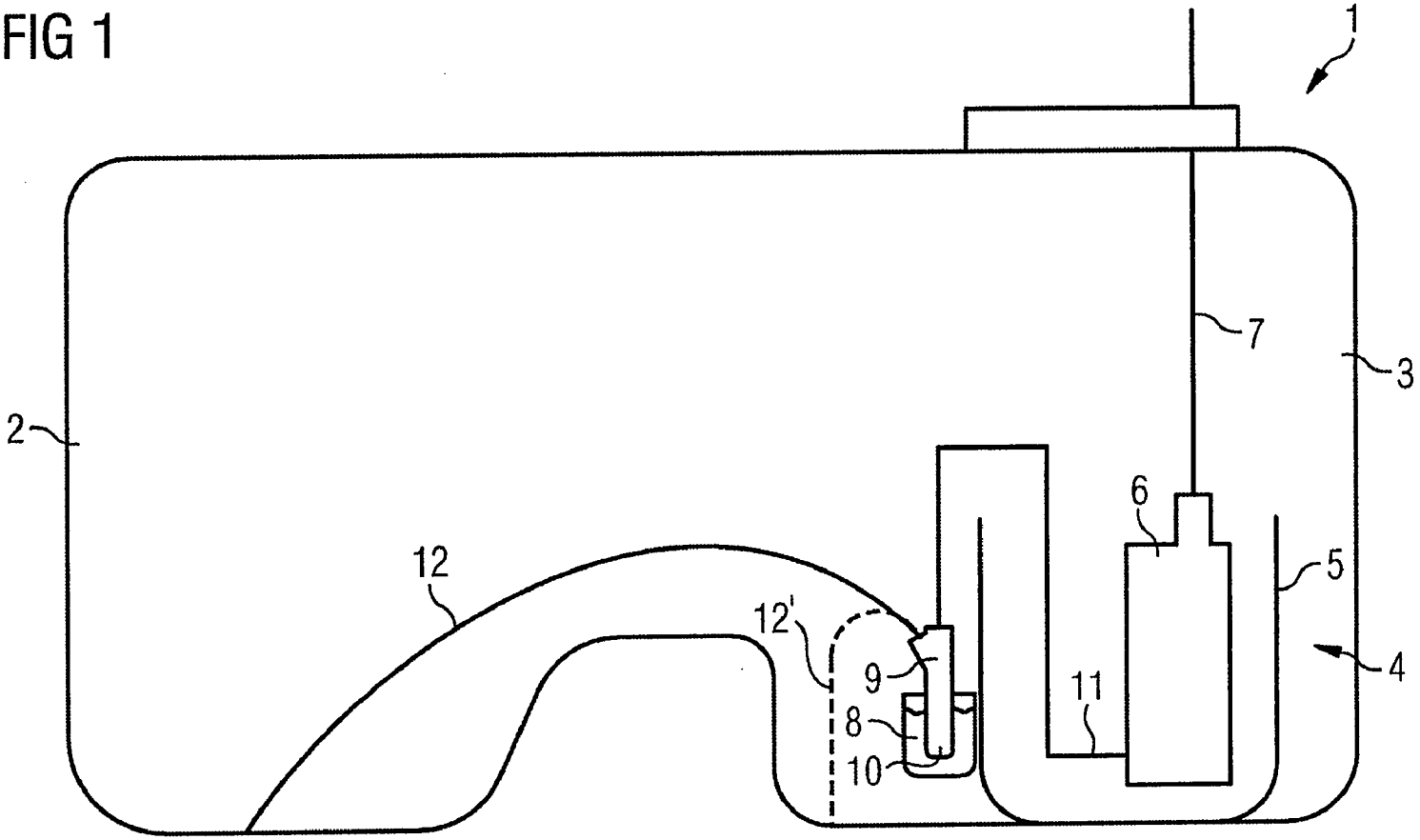
FIG. 1 shows a schematic arrangement of the jet suction pump in a fuel container.

According to an embodiment, the bottom of the pot has a shape differing from a planar surface.

By means of this shape of the bottom of the pot, the delivered medium emerging from the mixing pot at high velocity is split or swirled. This swirling of the medium ensures a permanent and reliable liquid closure of the outlet opening of the mixing pipe projecting into the pot, so that an adequate negative pressure can form in the jet suction pump, which permits the medium to be delivered to be sucked in over a great distance.

According to an embodiment, the shape differing from a planar surface is a depression in the form of a hollow or pocket in the bottom region of the pot. An embodiment of this type can be produced with little effort and is therefore particularly inexpensive.

A shape of the bottom of the pot that can likewise be produced beneficially is given by ribs arranged on the bottom of the pot. In this case, the ribs can be formed in one piece on the bottom of the pot if the pot is produced by means of injection molding.

The costs for the production of the depression or the ribs can be reduced if these are arranged in the region of the outlet opening of the mixing pipe.

In another refinement, the shape differing from a planar surface is a funnel-like bottom surface which extends over the entire bottom region.

According to an embodiment, the pot is connected to the jet suction pump. The pot can be integrally molded in one piece with the jet suction pump, preferably on the mixing pipe. However, the fabrication of the jet suction pump according to an embodiment is particularly simple if the pot is connected to the jet suction pump by means of a latching or plug-in connection. In this way, the pot forms one unit with the jet suction pump. As a result, the jet suction pump can be used at any desired locations.

The connection of pot and jet suction pump can be configured advantageously if there are latching or plug-in elements which interengage both on the jet suction pump and on the pot. The pot and the jet suction pump can be connected particularly simply if the pot has a groove in which a tongue integrally molded on the mixing pipe engages.

If the jet suction pump is used for filling the baffle pot, the jet suction pump is able to deliver over the upper edge into the baffle pot, advantageously being arranged in the region of the upper edge. The suction opening previously provided in the bottom of the baffle pot is no longer required. Likewise dispensed with, therefore, is the valve in the bottom region of the baffle pot, which closes the opening caused by the jet suction pump when the jet suction pump is not in operation.

The device according to an embodiment is configured particularly simply if the pot is formed by another component or is integrated into this component. Thus, the pot can be arranged on the baffle pot. In this case, the pot is either integrally formed on the baffle pot or it is fixed to the baffle pot. The baffle pot used in this case is configured particularly simply if part of the bottom is divided off, so that this divided off region forms the pot. Equally well, the baffle pot can have a molding on its outer wall which forms the pot for the jet suction pump. The advantage of these refinements is that only the jet suction pump has to be mounted.

A fuel container 1 comprising two chambers 2, 3 is illustrated in FIG. 1. Fixed in the fuel container 1 is a delivery unit 4, comprising a baffle pot 5 and a fuel pump 6 arranged therein. The fuel delivered by the fuel pump 6 to an internal combustion engine, not illustrated, is led via a flow line 7. A pot 8 is fixed to the outer wall of the baffle pot 5. A jet suction pump 9 is arranged in such a way in relation to the pot 8 that its mixing pipe 10 projects into the pot. Fuel from the fuel pump 6 is fed to the jet suction pump 9 via a line 11. A further line 12 extends from the jet suction pump 9 into the other chamber 2. Fuel from the chamber 2 is delivered directly into the baffle pot 5 via the line 12.

Figure 2:
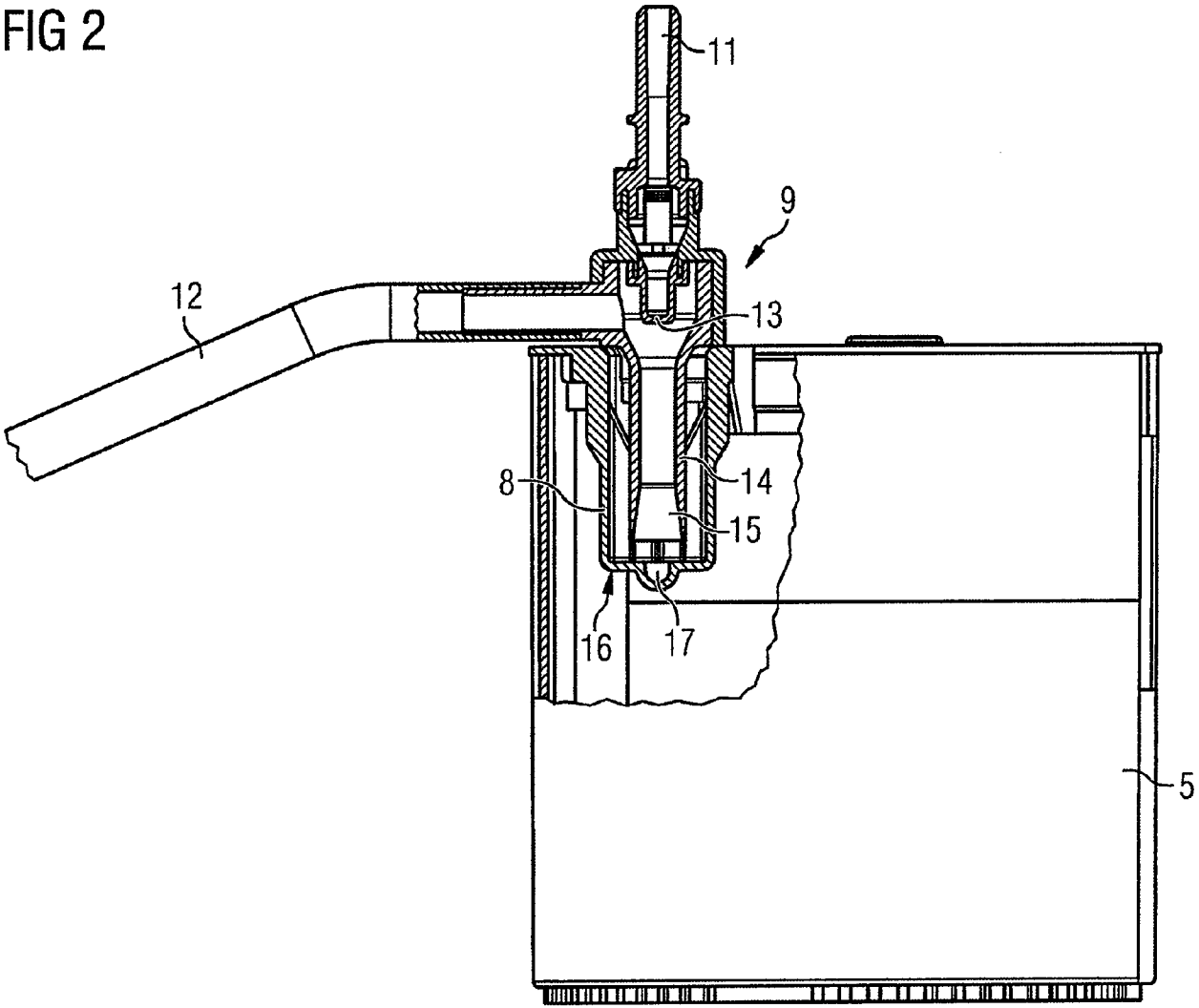
FIG. 2 shows the enlarged illustration of the jet suction pump according to FIG. 1, FIGS. 3*a, b* show the jet suction pump according to FIG. 2, FIGS. 4, 5 show various fixing of the jet suction pump to the pot.

The jet suction pump 9 illustrated in FIG. 2 comprises a propulsion jet nozzle 13, a mixing pipe 14, the suction line 12 and a pot 8, the pot 8, formed as a cover, being arranged on the upper edge of the baffle pot 5. In this case, the pot 8 can also be arranged as a separate component on a baffle pot 5 without a cover. By means of the propulsion jet line 11, a propulsion jet is fed to the jet suction pump 9. A nonreturn valve in the propulsion jet line seals off the latter with respect to running empty. The propulsion jet emerges through the propulsion jet nozzle 13 and enters the mixing pipe 14. In the region of the propulsion jet nozzle 13, the suction line 11 opens into the jet suction pump 9. The jet suction pump 9 is arranged vertically with respect to the axial extent of the mixing pipe 14. Furthermore, the jet suction pump 9 is arranged in relation to the pot 8 in such a way that the outlet opening 15 of the mixing pipe 14 dips into the pot 8. The propulsion jet passes out of the propulsion jet nozzle 13 via the mixing pipe 14 into the pot 8. The pot 8 has a bottom 16 with a pocket 17. When the jet strikes the pocket 17, the jet is swirled, as a result of which it seals off the outlet opening 15 and a liquid closure occurs in the mixing pipe 14 and therefore in the jet suction pump 9. On account of the now complete closure of the mixing pipe 14, the propulsion jet produces a substantially higher negative pressure, which is in turn sufficient to deliver a relatively large quantity of fuel into the pot 8 over a relatively great distance by means of the suction line 11.

Figure 3A:
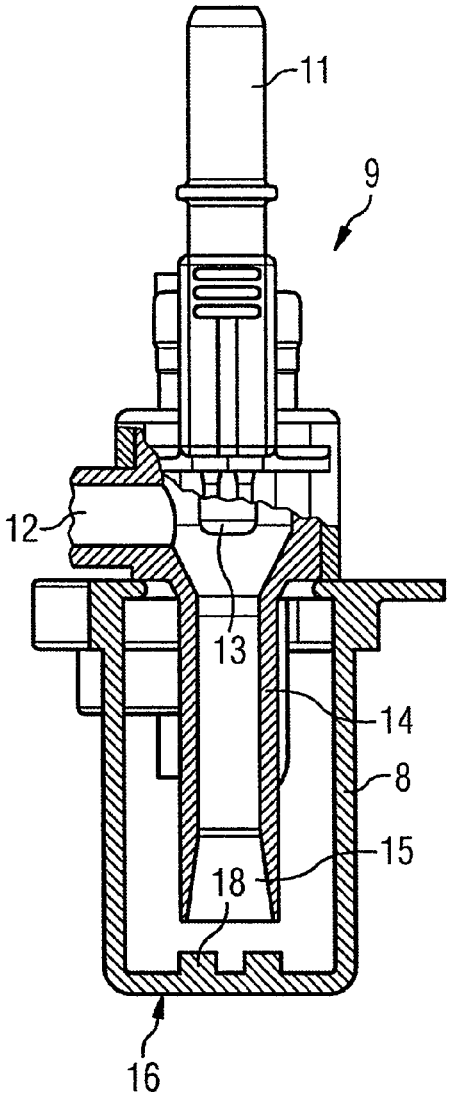
Figure 3B:
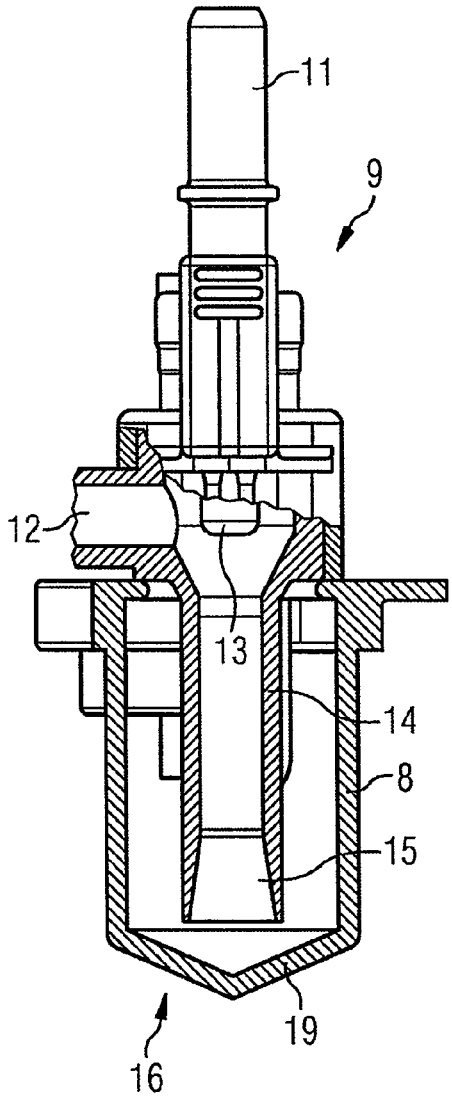

The jet suction pump 9 with the pot 8 in FIG. 3*a* differs from the design according to FIG. 2 only in the bottom region of the pot 8. The bottom region has ribs 18 integrally molded in one piece on the pot 8. These ribs 18 have the same effect as the pocket 17 in FIG. 2. By means of said ribs, the jet is swirled in such a way that the liquid closure occurs of the outlet opening 15 of the mixing pipe 14. Both the pocket 17 in FIG. 2 and the ribs are in each case formed only in the region of the mixing pipe 14 and not over the entire bottom region. As opposed to this, FIG. 3*b* shows a pot 8 having a funnel-like bottom surface 19 which extends over the entire bottom region.

Figure 4:
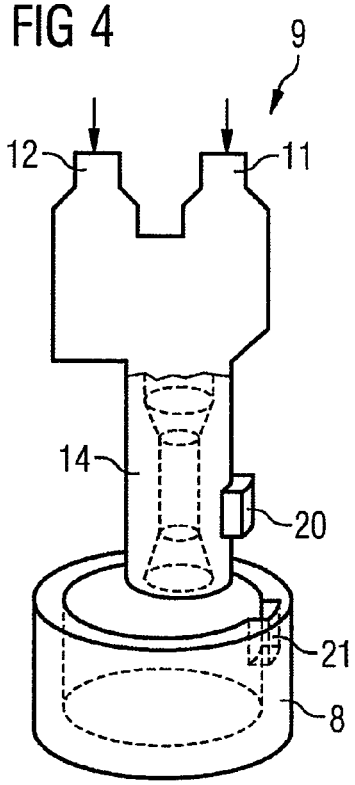

The jet suction pump 9 shown in FIG. 4 is connected to the pot 8 via a plug-in connection. Integrally molded on the outer side of the mixing pipe 14 is a tongue 20, while the inner wall of the pot 8 has a groove 21 at one point. In order to connect pot 8 and jet suction pump 9, the tongue 20 is pushed into the groove 21. When the lower groove limit is reached, the jet suction pump 9 is positioned in relation to the pot 8.

Figure 5:
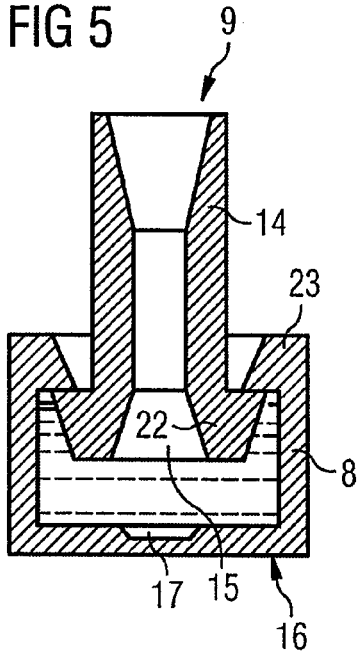

FIG. 5 shows a further refinement in the fixings of the jet suction pump 9 to the pot 8. On the mixing pipe 14, in the region of the outlet opening 15, latching elements are integrally molded in the form of latching hooks 22, which interact with correspondingly formed latching points 23 which are integrally molded on the pot 8. It is also conceivable to provide the latching hooks 22 on the pot 8, while the mixing pipe 14 has the necessary latching points 23.

Figure 6:
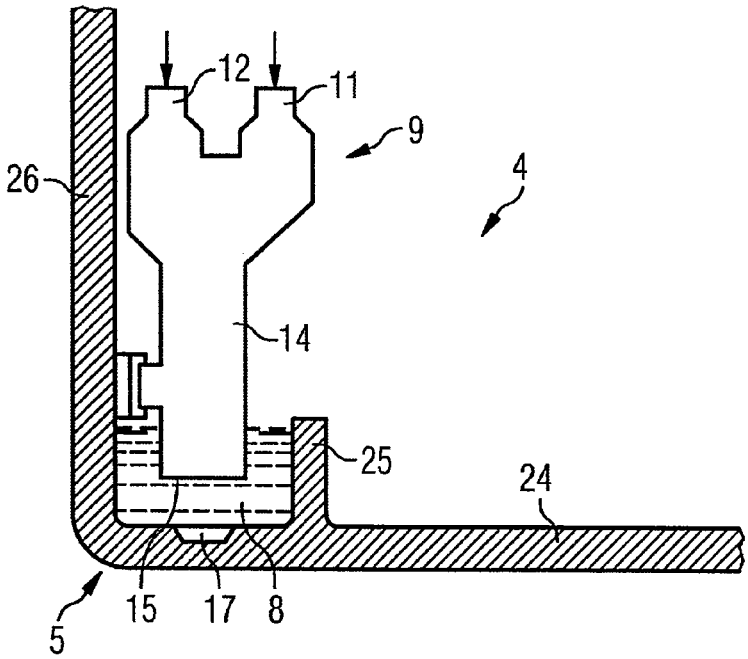
FIG. 6 shows the arrangement of the jet suction pump on a baffle pot.

In the refinement shown in FIG. 6, the pot 8 is not a separate component but a constituent part of the baffle pot 5 of the delivery unit 4. Integrally molded on the bottom 24 of the baffle pot 5 is a wall 25 which, together with the wall 26 of the baffle pot 5, forms the pot 8. The mixing pipe 14 projects with its outlet opening 16 into the pot 8. The fuel delivered by the jet suction pump 9 flows out of the pot 8 directly into the baffle pot 5. From there, the fuel is delivered to the internal combustion engine by the fuel pump, not illustrated.

What is claimed is:

1. A jet suction pump, comprising:

a propulsion jet nozzle with a round nozzle opening having a width, a mixing pipe, a suction line coupled to the mixing pipe, and a pot including a sidewall housing and a bottom, wherein the mixing pipe extends into the sidewall housing of the pot and includes an outlet opening that opens downwardly into the pot, and wherein the bottom of the pot includes:

a non-curved planar surface perpendicular to an axial direction of the propulsion jet nozzle, the non-curved planar surface extending in a single planar direction over substantially the entire bottom of the pot except in the location of one or more swirl-producing elements extending from the non-curved planar surface, the one or more swirl-producing elements configured to receive a downwardly-directed non-swirled flow of liquid delivered by the propulsion jet nozzle and produce a swirl in the flow of liquid to facilitate sealing off of the nozzle opening by the liquid, wherein the one or more swirl-producing elements include one or more ribs extending from the non-curved planar surface.

2. The jet suction pump according to claim 1, wherein the pot is connected to the jet suction pump.

3. The jet suction pump according to claim 2, wherein the pot is connected to the jet suction pump by means of a latching or plug-in connection.

4. The jet suction pump according to claim 2, wherein the pot is integrally formed on the jet suction pump.

5. The jet suction pump according to claim 4, wherein the pot is welded or adhesively bonded to the jet suction pump.

6. The jet suction pump according to claim 1, wherein the pot is formed on a baffle pot or in a region of a baffle pot.

7. The jet suction pump according to claim 1, wherein the one or more ribs are arranged in a region of the outlet opening of the mixing pipe.

8. A jet suction pump, comprising:

a propulsion jet nozzle with a round nozzle opening, a mixing pipe, a suction line coupled to the mixing pipe, and a pot including a sidewall housing and a bottom, wherein mixing pipe extends into the sidewall housing of the pot and includes an outlet opening that opens downwardly into the pot, and wherein the bottom of the pot includes:

a non-curved planar surface perpendicular to an axial direction of the propulsion jet nozzle, the non-curved planar surface extending in a single planar direction over substantially the entire bottom of the pot except in the location of a rounded pocket formed in the non-curved planar surface perpendicular to the axial direction of the propulsion jet nozzle, the rounded pocket being axially centered with respect to the mixing pipe, the rounded pocket configured to receive a downwardly-directed non-swirled flow of liquid delivered by the propulsion jet nozzle and produce a swirl in the flow of liquid to facilitate sealing off of the nozzle opening by the liquid.

9. The jet suction pump according to claim 8, wherein the rounded pocket is arranged in a region of the outlet opening of the mixing pipe.

10. The jet suction pump according to claim 8, wherein the pot is connected to the jet suction pump.

11. The jet suction pump according to claim 10, wherein the pot is connected to the jet suction pump by means of a latching or plug-in connection.

12. The jet suction pump according to claim 10, wherein the pot is integrally formed on the jet suction pump.

13. The jet suction pump according to claim 12, wherein the pot is welded or adhesively bonded to the jet suction pump.

14. The jet suction pump according to claim 8, wherein the pot is formed on a baffle pot or in a region of a baffle pot.

* * * * *